US008181713B2

(12) United States Patent
White

(10) Patent No.: US 8,181,713 B2
(45) **Date of Patent: *May 22, 2012**

(54) PRELOADED DROP HAMMER FOR DRIVING PILES

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 6 days.

This patent is subject to a terminal disclaimer.

(21) Appl. No.: 12/758,723

(22) Filed: Apr. 12, 2010

(65) Prior Publication Data

US 2010/0212922 A1 Aug. 26, 2010

Related U.S. Application Data

(63) Continuation of application No. 10/667,176, filed on Sep. 17, 2003, now Pat. No. 7,694,747.

(60) Provisional application No. 60/411,683, filed on Sep. 17, 2002.

(51) Int. Cl.
*B25D 9/00* (2006.01)

(52) U.S. Cl. ..... 173/1; 173/89; 173/132; 173/212

(58) Field of Classification Search ..... 173/133, 173/135–137, 206, 208, 209, 89, 212; 405/232
See application file for complete search history.

(56) References Cited

U.S. PATENT DOCUMENTS 3,193,026 A 7/1965 Kupka
3,789,930 A * 2/1974 Nishimura et al. ..... 173/1
3,797,585 A 3/1974 Ludvigson
3,822,969 A 7/1974 Kummel
3,967,688 A 7/1976 Inenaga et al.
3,975,918 A 8/1976 Jansz
4,076,081 A 2/1978 Schnell
4,109,475 A 8/1978 Schnell
4,154,307 A 5/1979 Gendron et al.
4,362,216 A 12/1982 Jansz
4,421,180 A * 12/1983 Fleishman et al. ..... 173/124
4,497,376 A 2/1985 Kurylko
4,799,557 A 1/1989 Jacquemet
4,844,661 A 7/1989 Martin et al.

(Continued)

OTHER PUBLICATIONS

Shanghai Jintai Semw, Portions of Operations Manual for Diesel Hammers Depicting the Basic Operation of Diesel Hammers and Fuel Pumps Used by Commercially Available Diesel Hammers, 8 pages.

(Continued)

*Primary Examiner* — Thanh K Truong
(74) *Attorney, Agent, or Firm* — Michael R. Schacht; Schacht Law Office, Inc.

(57) ABSTRACT

A drop hammer for driving a pile. The drop hammer of the present invention comprises a housing member, a ram member, a helmet member, and a lifting system. The housing member defines a housing chamber and a vent port defining a preload position. The ram member is supported for movement within the housing chamber. When the lifting system raises the ram member above the preload position, ambient air substantially freely flows into and out of the housing chamber through the vent port. When the ram member falls below the preload position, ambient air within a preload chamber portion of the housing chamber compresses to apply a preload force on the inner portion of the helmet member. When the ram member moves into the lower position, the ram member impacts the helmet member to force the helmet member from the rest position to the impact position, thereby driving the pile.

18 Claims, 4 Drawing Sheets

U.S. PATENT DOCUMENTS

| | | | | |
|---|---|---|---|---|
| 4,993,500 | A | 2/1991 | Greene et al. | |
| 5,088,565 | A | 2/1992 | Evarts | |
| 5,117,925 | A | 6/1992 | White | |
| 5,154,667 | A | 10/1992 | Mauch et al. | |
| 5,263,544 | A | 11/1993 | White | |
| 5,355,964 | A | 10/1994 | White | |
| 5,544,979 | A | 8/1996 | White | |
| 5,609,380 | A | 3/1997 | White | |
| 5,653,556 | A | 8/1997 | White | |
| 5,727,639 | A | 3/1998 | Jeter | |
| 5,794,716 | A | 8/1998 | White | |
| 6,003,619 | A | 12/1999 | Lange | |
| 6,039,508 | A | 3/2000 | White | |
| 6,102,133 | A * | 8/2000 | Scheid et al. | 173/208 |
| 6,427,402 | B1 | 8/2002 | White | |
| 6,431,795 | B2 | 8/2002 | White | |
| 6,447,036 | B1 | 9/2002 | White | |
| 6,543,966 | B2 | 4/2003 | White | |
| 6,557,647 | B2 | 5/2003 | White | |
| 6,648,556 | B1 | 11/2003 | White | |
| 6,672,805 | B1 | 1/2004 | White | |
| 6,732,483 | B1 | 5/2004 | White | |
| 6,736,218 | B1 * | 5/2004 | White | 173/135 |
| 6,896,448 | B1 | 5/2005 | White | |
| 6,908,262 | B1 | 6/2005 | White | |
| 6,988,564 | B2 | 1/2006 | White | |
| 7,168,890 | B1 | 1/2007 | Evarts | |
| 7,392,855 | B1 | 7/2008 | White | |
| 7,694,747 | B1 * | 4/2010 | White | 173/1 |
| 7,708,499 | B1 | 5/2010 | Evarts et al. | |
| 7,824,132 | B1 | 11/2010 | White | |
| 7,854,571 | B1 | 12/2010 | Evarts | |
| 7,950,877 | B2 | 5/2011 | Evarts | |

OTHER PUBLICATIONS

USPTO, Office Action U.S. Appl. No. 10/667,176, Jan. 11, 2005, 8 pages.
Schacht Law Office, Response U.S. Appl. No. 10/667,176, Apr. 7, 2005, 11 pages.
USPTO, Office Action U.S. Appl. No. 10/667,176, Jun. 23, 2005, 7 pages.
Schacht Law Office, RCE U.S. Appl. No. 10/667,176, Sep. 23, 2005, 9 pages.
USPTO, Office Action U.S. Appl. No. 10/667,176, Nov. 17, 2005, 9 pages.
Schacht Law Office, RCE U.S. Appl. No. 10/667,176, Apr. 6, 2006, 12 pages.
USPTO, Office Action U.S. Appl. No. 10/667,176, Jun. 7, 2006, 7 pages.
Schacht Law Office, RCE U.S. Appl. No. 10/667,176, Sep, 7, 2006, 11 pages.
USPTO, Office Action U.S. Appl. No. 10/667,176, Oct. 12, 2006, 8 pages.
Schacht Law Office, Response U.S. Appl. No. 10/667,176, Jan. 12, 2007, 5 pages.
USPTO, Office Action U.S. Appl. No. 10/667,176, Oct. 10, 2007, 6 pages.
Schacht Law Office, Response U.S. Appl. No. 10/667,176, Jan. 10, 2008, 10 pages.
USPTO, Office Action U.S. Appl. No. 10/667,176, Apr. 11, 2008, 12 pages.
Schacht Law Office, RCE U.S. Appl. No. 10/667,176, Aug. 11, 2008, 11 pages.
USPTO, Office Action U.S. Appl. No. 10/667,176, Sep. 12, 2008, 10 pages.
Schacht Law Office, Response U.S. Appl. No. 10/667,176, Dec. 12, 2008, 11 pages.
USPTO, Office Action U.S. Appl. No. 10/667,176, Jun. 9, 2009 11 pages.
Schacht Law Office, RCE U.S. Appl. No. 10/667,176, Nov. 9, 2009, 14 pages.
USPTO, Notice of Allowance U.S. Appl. No. 10/667,176, Nov. 30, 2009, 11 pages.

* cited by examiner 20
22
30
32
34
36
38
40
42
44
46
48
50
52
54
56
58
60
70
80
82
84
86
88

PRELOADED DROP HAMMER FOR DRIVING PILES

RELATED APPLICATIONS

This application is a continuation of U.S. application Ser. No. 10/667,176, filed Sep. 17, 2003, which claims priority of U.S. Provisional Application Ser. No. 60/411,683 filed on Sep. 17, 2002.

TECHNICAL FIELD

The present invention relates to methods and apparatus for inserting elongate members into the earth and, more particularly, to drop hammers that create pile driving forces by lifting and dropping a hammer to apply a driving force to the top of a pile.

BACKGROUND

For certain construction projects, elongate members such as piles, anchor members, caissons, and mandrels for inserting wick drain material must be placed into the earth. It is well-known that such rigid members may often be driven into the earth without prior excavation. The term "piles" will be used herein to refer to the elongate rigid members typically driven into the earth.

One system for driving piles is conventionally referred to as a diesel hammer. A diesel hammer employs a floating ram member that acts both as a ram for driving the pile and as a piston for compressing diesel fuel. Diesel fuel is injected into a combustion chamber below the ram member as the ram member drops. The dropping ram member engages a helmet member that transfers the load of the ram member to the pile to drive the pile. At the same time, the diesel fuel ignites, forcing the ram member and the helmet member in opposite directions. The helmet member further drives the pile, while the ram member begins a new combustion cycle. Another such system is a drop hammer that repeatedly lifts and drops a hammer onto an upper end of the pile to drive the pile into the earth.

Diesel hammers seem to exhibit fewer problems with tension cracking in concrete piles than similarly configured external combustion hammers. The Applicants have recognized that the combustion chambers of diesel hammers preload the system before the hammer impact and that this preloading may explain the reduction of tension cracking in concrete piles associated with diesel hammers.

The need thus exists for improved drop hammers that induce stresses in the pile driven that are similar to the stresses induced by diesel hammers.

SUMMARY

The present invention may be embodied as a drop hammer for driving a pile comprising a housing member, a ram member, a helmet member, and a lifting system. The housing member defines a housing chamber and a vent port arranged between lower and upper positions, where the vent port defines a preload position. The ram member supported within the housing chamber for movement relative to the housing member between the lower position and the upper position. The helmet member is supported by the housing member for movement relative to the housing member between a rest position and an impact position. The lifting system moves the ram member from the lower position to the upper position during each cycle. When the lifting system raises the ram member above the preload position, ambient air substantially freely flows into and out of the housing chamber through the vent port. When the ram member falls below the preload position, fluid is prevented from flowing through the vent port such that ambient air within a preload chamber portion of the housing chamber compresses to apply a preload force on the inner portion of the helmet member. When the ram member moves into the lower position, the ram member impacts the helmet member to force the helmet member from the rest position to the impact position, thereby driving the pile.

The present invention may also be embodied as a method of driving a pile comprising the following steps. A housing member defining a housing chamber is provided. A vent port is formed in the housing member between lower and upper positions, where the vent port defines a preload position. A helmet member is supported from the housing member for movement relative to the housing member between a rest position and an impact position. A ram member is supported within the housing chamber for movement relative to the housing member between the upper position and the lower position. The helmet member is connected to the pile. The ram member is raised into the upper position. The ram member is allowed to fall from the upper position to the lower position such that the impact of the ram member to force the helmet member from the rest position to the impact position, thereby driving the pile. While the ram member is above a preload position, ambient air substantially freely flows into and out of the housing chamber through the vent port. While the ram member is below the preload position, fluid is prevented from flowing through the vent port such that ambient air within the preload chamber portion of the housing chamber is substantially prevented from flowing out of the preload chamber portion of the housing chamber such that ambient air within the preload chamber portion of the housing chamber compresses as the ram member moves from the preload position to the lower position to apply a preload force on the helmet member prior to impact of the ram member on the helmet member.

The present invention may also be embodied as a drop hammer for driving a pile comprising a housing member, a ram member, a helmet member, and a lifting system. The housing member defines a housing chamber and a vent port between lower and upper positions. The ram member is supported within the housing chamber for movement relative to the housing member between the upper position and the lower position. The helmet member is supported by the housing member for movement relative to the housing member between a rest position and an impact position. The lifting system raises the ram member from the lower position to the upper position during each cycle. As the ram member moves between the upper position and a preload position defined by the vent port, ambient air substantially freely flows into and out of the housing chamber through the vent port. When the ram member falls below the preload position, fluid is prevented from flowing through the vent port such that ambient air within a preload chamber portion of the housing chamber below the vent port compresses as the ram member moves into the lower position to apply a preload force on the helmet member. When the ram member moves into the lower position, the impact of the ram member on the helmet member drives the pile.

DETAILED DESCRIPTION

Figures 1A, 1B, 1C, 1D, 1E:
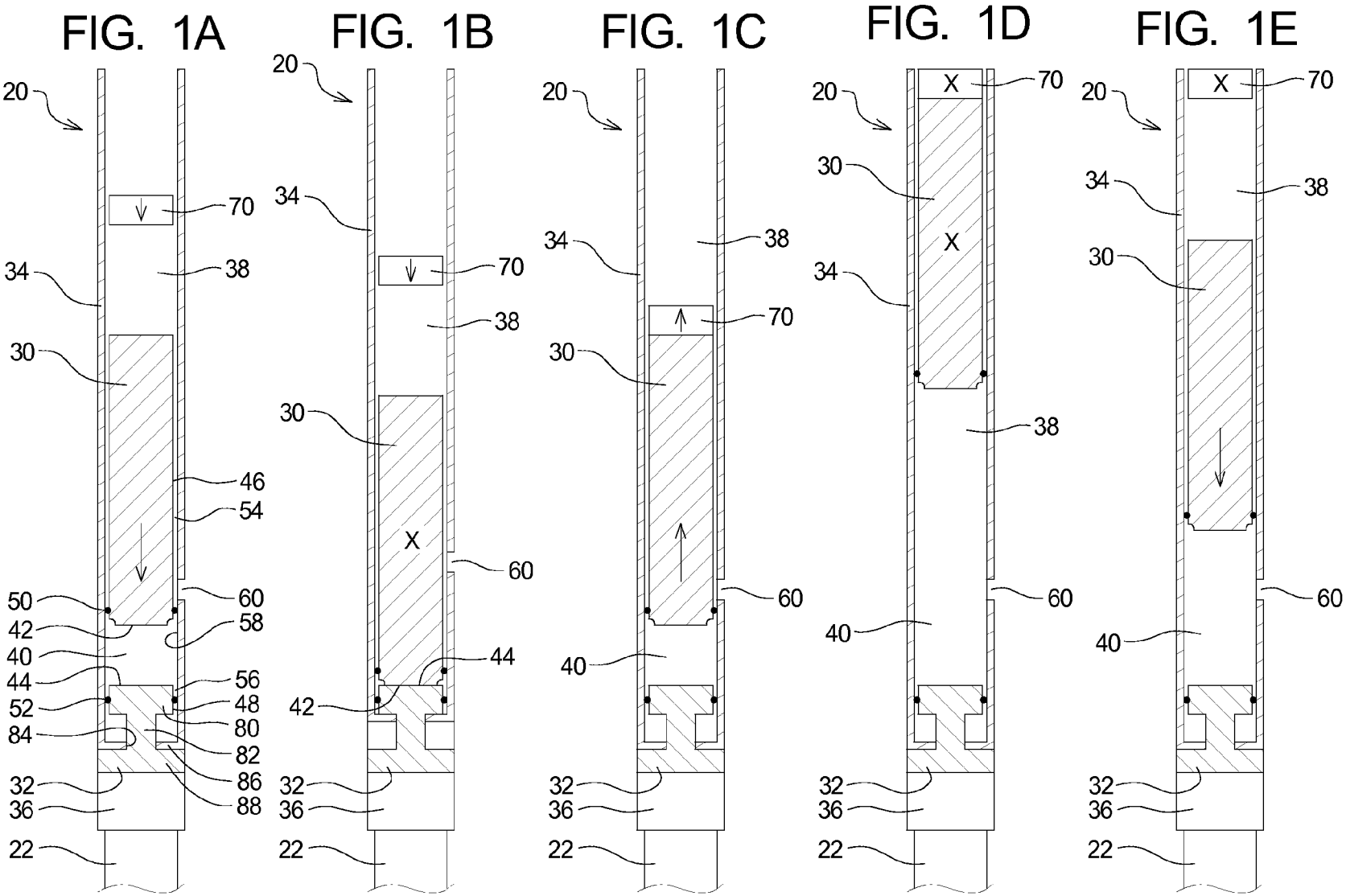
FIGS. 1A-1E are somewhat schematic sectional views of a drop hammer of the present invention depicting the drive cycle thereof.

Turning to the drawing, depicted at 20 in FIGS. 1A-1E is a drop hammer system constructed in accordance with, and embodying, the principles of the present invention. The drop hammer system 20 is designed to insert a pile 22 into the ground. The drop hammer system 20 will include a spotter, crane, or other equipment as necessary to hold the hammer system 20 in a desired orientation with respect to the ground. Such structural components of the hammer system 20 are conventional and will not be described herein.

The drop hammer system 20 comprises a ram member 30, a helmet member 32, a housing member 34, and a clamp assembly 36. The housing member defines a housing chamber 38. The ram member 30 is guided by the housing member 34 for movement within the housing chamber 38 between a lower position (FIG. 1B) and an upper position (FIG. 1D). The helmet member 32 is guided by the housing member 34 for movement between a rest position (FIG. 1A) and an impact position (FIG. 1B). The helmet member 32 is rigidly connected to the clamp assembly 36. The clamp assembly 36 is detachably fixed relative to the pile 22.

A preload chamber portion 40 is formed within the housing chamber 38 of the housing member 34 between a lower surface 42 of the ram member 30 and an upper surface 44 of the helmet member 32. The ram member 30 further defines an outer surface 46, while the helmet member 32 defines an outer surface 48. First and second seals 50 and 52 are arranged in first and second gaps 54 and 56 between an inner surface 46 of the housing member 34 and the outer surface 46 of the ram member 30 and outer surface 48 of the helmet member 32, respectively. When the seals 50 and 52 function properly, fluid is substantially prevented from flowing out of the preload chamber portion 40 through the gaps 54 and 56 under certain conditions.

In particular, a vent port 60 is formed in the housing member 34. The vent port 60 is arranged to allow exhaust gasses to be expelled from the preload chamber portion 40 under certain conditions and to allow air to be drawn into the chamber 40 under other conditions. The vent port 60 thus defines a preload position above which fluid can flow into and out of the preload chamber portion 40 and below which the preload chamber portion 40 is substantially sealed.

FIG. 1 illustrates a latch assembly 70 that moved up and down as will generally be described below. The latch assembly 70 represents an external lifting system that lifts the ram member 30 from the lower position to the upper position. The latch assembly 70 mechanically latches onto the ram member 30 during lifting and releases from the ram member 30 when the ram member reaches its upper position. The latch assembly 70 and external lifting system are well-known in the art and will not be described herein in detail.

The drop hammer system 20 operates in a drive cycle that will now be described with reference to FIG. 1. Referring initially to FIG. 1A, the hammer system 20 is shown in a preload state. In the preload state, the ram member 30 has dropped past the vent port 60 such that the first seal 50 prevents fluid from flowing out of the preload chamber portion 40. The second seal 52 seals the opposite end of the preload chamber portion 40 as generally described above. Accordingly, at this point the preload chamber portion 40 is effectively sealed, and continued dropping of the ram member 30 compresses the fluid within the preload chamber portion 40. During this preload state, the helmet 32, the clamp assembly 36, and the pile 22 are gradually forced together by the compressed fluid in the preload chamber portion 40.

Referring now to FIG. 1B, the hammer system 20 is shown in an impact state in which the lower surface 42 of the ram member 30 contacts the upper surface 44 of the helmet member 32. In the impact state, the ram member 30 drives the helmet member 32 towards the pile 22 relative to the housing member 34 as shown by a comparison of FIGS. 1A and 1B. The helmet member 32 thus drives the pile 22 downward through the clamp assembly 36. In addition, the housing member 34 will immediately fall onto the helmet member 32, thereby applying additional driving forces onto the pile member 22.

After impact, the helmet member 32 is raised to an upper position as shown in FIG. 1C. As the helmet member 32 moves into the upper position, the lower end of the ram member 30 passes the vent port 60. As the ram member continues on to its upper position, ambient air is drawn into the preload chamber portion 40 through the vent port 60, thereby reducing resistance to continued upward movement of the helmet member 32. As generally described above, the ram member 32 is raised by the latch assembly 70, which is in turn driven by an external combustion source in a manner similar to that of a conventional drop hammer. In addition or instead, a hydraulic actuator may be used to raise the latch assembly 70 and ram member 32.

After the ram member 30 reaches the upper position as shown in FIG. 1D, the latch assembly 70 releases and the ram member 30 is allowed to drop again. The system 20 then enters a free-fall state as shown in FIG. 1E. In the free-fall state, the preload chamber portion 40 is not sealed, and air is allowed to escape through the vent port 60, again reducing resistance to downward movement of the ram member 32. As the ram member 30 continues to drop, the first seal 50 on the ram member 32 again passes the vent port 60, which seals preload chamber portion 40. Again, the system 20 enters the preload state as described with reference to FIG. 1A. At this point, and the drive cycle begins again.

Given the foregoing general discussion of the invention, certain aspects of the exemplary hammer system 20 will now be described in further detail. The helmet member 32 comprises an inner portion 80 that lies within the preload chamber portion 40, a connecting portion 82 that extends through a helmet opening 84 formed in a bottom wall 86 of the housing member 34, and an outer portion 88 that is connected to the clamp assembly 36. The length of the connecting portion 82 (i.e., the distance between the inner portion 80 and outer portion 88) defines the range of movement of the helmet member 32 between the rest position and the impact position. The second seal 52 is formed on the inner portion 80 of the helmet member 32.

Figure 2:
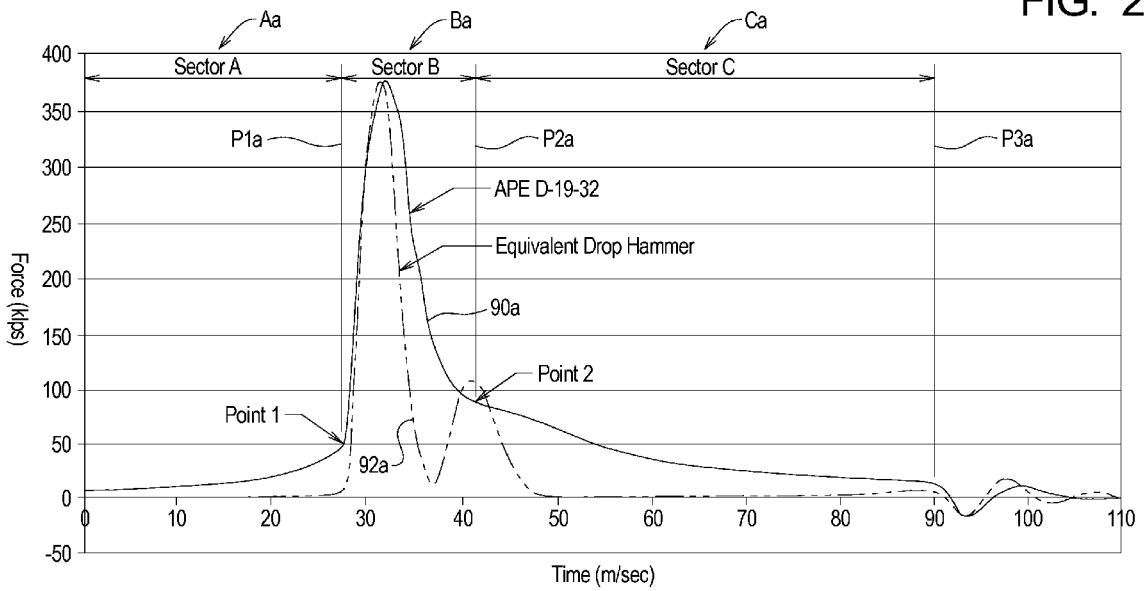
FIGS. 2-4 represent computer simulations of force records comparing a conventional drop hammer with a conventional diesel hammer under various conditions.
Figure 3:
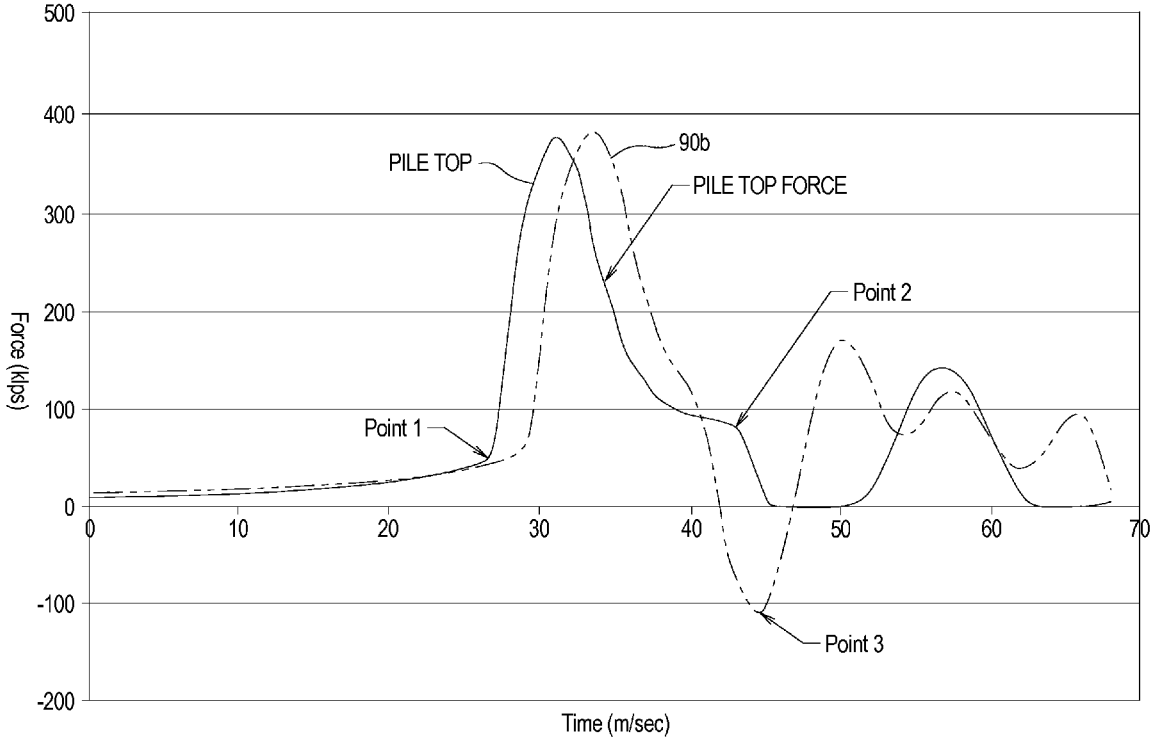
Figure 4:
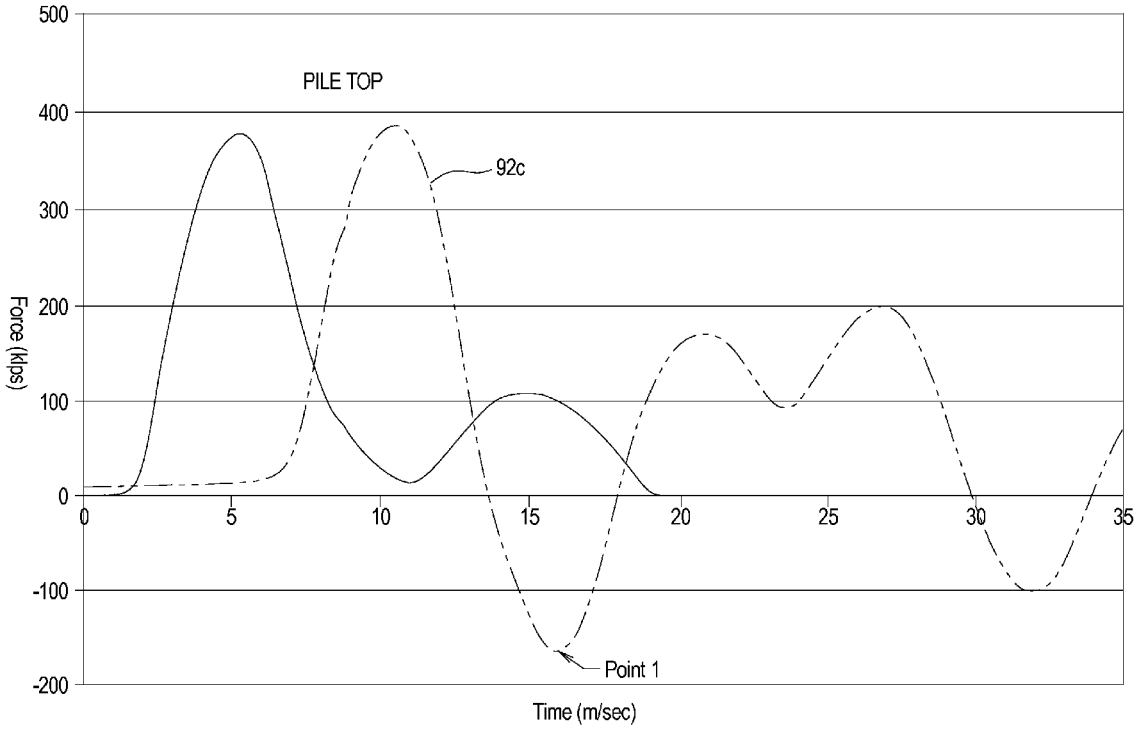

The theoretical benefits of preloading the system by compressing fluid prior to impact will now be described with reference to FIGS. 2-4. FIGS. 2, 3, and 4 plots computer generated models illustrating force versus time for various diesel and drop hammer configurations.

FIG. 2 illustrates the difference between a diesel hammer and a conventional drop hammer. The plot of FIG. 2 assumes the following conditions: 12" square concrete pile 400' in length with a three-inch thick plywood pile cushion; the pile was embedded 20 feet with a total soil resistance of 100 kips. The 400' pile length is not realistic but illustrates wave compression at the upper end of the pile without the effects of reflected waves. Trace 90*a* corresponds to the force record of an American Piledriving Equipment D-19-32 diesel hammer, while trace 92*a* corresponds to a conventional drop hammer of similar geometry and weight under the same conditions.

The trace 90*a* illustrates that the force during the time corresponding to a first time second Aa in FIG. 2 is the pile top force caused by the diesel hammer pre-compression force. In the first time sector Aa, the ram has moved past the exhaust ports and is compressing the air in the combustion chamber and thereby exerting a force on the pile. Impact occurs at first time point P1*a* at the end of the first time sector Aa. The impact exerts an impact force during a second time sector Ba between the first point P1*a* and a second time point P2*a*. This second sector Ba represents the force at the top of the pile from the time of impact to the time of ram separation. During this second time sector Ba, pile penetration is induced by the large force arising from ram impact. Somewhere around the second time point P2*a*, the ram has separated from the impact block. A third time sector Ca begins at the second time point P2*a*; the third time period corresponds to the period from ram separation to the arrival of the reflection of the impact wave back from the toe of the pile. The force during this time comes from the combustion chamber pressure.

The force associated with the conventional drop hammer is shown by the trace 92*a*. The trace 92*a* illustrates that the stroke is set such that the same peak impact force was obtained. The double humped force record in sector Ba associated with impact is likely due to the dynamic interaction of the ram, pile cushion, and helmet. While a similar effect is associated with trace 90*a* in sector Ba, the effects of the dynamic interaction of the ram, pile cushion, and helmet are likely smoothed by the combustion chamber pressure. After the impact as shown at P1*a*, the drop hammer force stays near zero during the third time sector Ca.

The relatively slow decay of the induced force after the impact event associated with the diesel hammer trace 90*a* provides a compression force that acts to reduce the magnitude of any reflected tension stresses. The downward traveling compression wave associated with the trace 90*a* reduces the reflected tension wave from the pile toe.

FIG. 3 illustrates a more realistic example using a conventional diesel hammer system to drive a pile having a length of 100'; all other conditions are also the same. As shown by trace 90*b*, the element with the largest tension stress was located about 30 feet from the top of the pile. The maximum tension force at point 3 in FIG. 3 was 106 kips or 736 psi.

FIG. 4 contains a trace 92*c* of a conventional drop hammer. Illustrated at point 1 on the trace 92*c* in FIG. 4 is element with the largest tension stress. This element is about 30 feet from the bottom of the pile and represents a maximum tension force of approximately 166 kips or 1,140 psi. The tension force associated with the trace 92*c* is thus significantly larger than that represented by the trace 90*b*.

Given the foregoing, the Applicants have concluded that the operation of conventional drop hammer systems can be improved by establishing a pre-load state prior to impact that is generally similar to the compression state of a diesel hammer. The Applicants believe that the preload state will stretch out the compression force in the stress wave and thereby substantially reduce the possibility of tension cracking and damage in concrete piles.

What is claimed is:

1. A drop hammer for driving a pile comprising:

a housing member defining a housing chamber and a vent port arranged between lower and upper positions, where the vent port defines a preload position;

a ram member supported within the housing chamber for movement relative to the housing member between the lower position and the upper position;

a helmet member supported by the housing member for movement relative to the housing member between a rest position and an impact position; and a lifting system for moving the ram member from the lower position to the upper position during each cycle; whereby when the lifting system raises the ram member above the preload position, ambient air substantially freely flows into and out of the housing chamber through the vent port;

when the ram member falls below the preload position, fluid is prevented from flowing through the vent port such that ambient air within a preload chamber portion of the housing chamber compresses to apply a preload force on the inner portion of the helmet member; and when the ram member moves into the lower position, the ram member impacts the helmet member to force the helmet member from the rest position to the impact position, thereby driving the pile.

2. A drop hammer as recited in claim 1, further comprising seal system for sealing the preload chamber portion of the housing chamber when the ram member is below the preload position.

3. A drop hammer as recited in claim 2, in which:

the ram member defines a ram side wall;

the housing member defines a housing interior wall;

the seal system comprises a ram seal for inhibiting fluid flow between the ram side wall and the housing interior wall.

4. A drop hammer as recited in claim 2, further comprising:

a helmet member supported by the housing member for movement relative to the housing member between a rest position and an impact position; wherein the impact of the ram member is transmitted to the pile through the helmet member;

the helmet member extends through a helmet opening formed in the housing member; and the seal system comprises a helmet seal for inhibiting fluid flow between the helmet member and the housing member through the helmet opening.

5. A drop hammer as recited in claim 4, in which:

the ram member defines a ram side wall;

the housing member defines a housing interior wall;

the seal system comprises a ram seal for inhibiting fluid flow between the ram side wall and the housing interior wall.

6. A drop hammer as recited in claim 1, further comprising a clamp assembly for securing the helmet member to the pile.

7. A method of driving a pile comprising:

providing a housing member defining a housing chamber;

forming a vent port between in the housing member between lower and upper positions, where the vent port defines a preload position;

supporting a helmet member from the housing member for movement relative to the housing member between a rest position and an impact position;

supporting a ram member within the housing chamber for movement relative to the housing member between the upper position and the lower position;

connecting the helmet member to the pile;

raising the ram member into the upper position;

allowing the ram member to fall from the upper position to the lower position such that the impact of the ram member to force the helmet member from the rest position to the impact position, thereby driving the pile;

while the ram member is above a preload position, ambient air substantially freely flows into and out of the housing chamber through the vent port; and while the ram member is below the preload position, fluid is prevented from flowing through the vent port such that ambient air within the preload chamber portion of the housing chamber is substantially prevented from flowing out of the preload chamber portion of the housing chamber such that ambient air within the preload chamber portion of the housing chamber compresses as the ram member moves from the preload position to the lower position to apply a preload force on the helmet member prior to impact of the ram member on the helmet member.

8. A method as recited in claim 7, in which the step of substantially preventing ambient air from flowing out of the preload chamber portion of the housing chamber comprises the step of sealing the preload chamber portion of the housing chamber when the ram member is below the preload position.

9. A method as recited in claim 8, further comprising the steps of:

supporting a helmet member for movement relative to the housing member between a rest position and an impact position, where the helmet member extends through a helmet opening formed in the housing member, and the impact of the ram member is transmitted to the pile through the helmet member; wherein the step of providing the seal system comprises the step of arranging a helmet seal to inhibit fluid flow between the helmet member and the housing member through the helmet opening.

10. A method as recited in claim 9, further comprising the step of providing a ram seal for inhibiting fluid flow between a side wall of the ram and an interior wall of the housing.

11. A method as recited in claim 7, further comprising the step of providing a ram seal for inhibiting fluid flow between a side wall of the ram and an interior wall of the housing.

12. A method as recited in claim 7, further comprising a clamp assembly for securing the helmet member to the pile.

13. A drop hammer for driving a pile comprising:

a housing member defining a housing chamber and a vent port between lower and upper positions;

a ram member supported within the housing chamber for movement relative to the housing member between the upper position and the lower position;

a helmet member supported by the housing member for movement relative to the housing member between a rest position and an impact position; and a lifting system for raising the ram member from the lower position to the upper position during each cycle; whereby as the ram member moves between the upper position and a preload position defined by the vent port, ambient air substantially freely flows into and out of the housing chamber through the vent port;

when the ram member falls below the preload position, fluid is prevented from flowing through the vent port such that ambient air within a preload chamber portion of the housing chamber below the vent port compresses as the ram member moves into the lower position to apply a preload force on the helmet member; and when the ram member moves into the lower position, the impact of the ram member on the helmet member drives the pile.

14. A drop hammer as recited in claim 13, further comprising seal system for sealing the preload chamber portion of the housing chamber when the ram member is below the preload position.

15. A drop hammer as recited in claim 14, in which:

the ram member defines a ram side wall;

the housing member defines a housing interior wall;

the seal system comprises a ram seal for inhibiting fluid flow between the ram side wall and the housing interior wall.

16. A drop hammer as recited in claim 14, further comprising:

a helmet member supported by the housing member for movement relative to the housing member between a rest position and an impact position; wherein the impact of the ram member is transmitted to the pile through the helmet member;

the helmet member extends through a helmet opening formed in the housing member; and the seal system comprises a helmet seal for inhibiting fluid flow between the helmet member and the housing member through the helmet opening.

17. A drop hammer as recited in claim 16, in which:

the ram member defines a ram side wall;

the housing member defines a housing interior wall;

the seal system comprises a ram seal for inhibiting fluid flow between the ram side wall and the housing interior wall.

18. A drop hammer as recited in claim 13, further comprising a clamp assembly for securing the helmet member to the pile.

* * * * *